US009287015B2

(12) United States Patent
Baurichter et al.

(10) Patent No.: US 9,287,015 B2
(45) Date of Patent: Mar. 15, 2016

(54) METHOD AND DEVICE FOR PRODUCING TWO DIFFERENT RADIOACTIVE ISOTOPES

(75) Inventors: Arnd Baurichter, Odense (DK); Oliver Heid, Erlangen (DE); Timothy Hughes, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 370 days.

(21) Appl. No.: 13/576,446

(22) PCT Filed: Jan. 26, 2011

(86) PCT No.: PCT/EP2011/051019

§ 371 (c)(1), (2), (4) Date: Aug. 31, 2012

(87) PCT Pub. No.: WO2011/092175

PCT Pub. Date: Aug. 4, 2011

(65) Prior Publication Data

US 2012/0321027 A1 Dec. 20, 2012

(30) Foreign Application Priority Data

Feb. 1, 2010 (DE) ..... 10 2010 006 433

(51) Int. Cl.

*G21G 1/00* (2006.01)
*G21G 1/10* (2006.01)
*H05H 6/00* (2006.01)

(52) U.S. Cl.

CPC . *G21G 1/10* (2013.01); *H05H 6/00* (2013.01); *G21G 2001/0015* (2013.01); *G21G 2001/0036* (2013.01); *G21G 2001/0042* (2013.01)

(58) Field of Classification Search

None

See application file for complete search history.

(56) References Cited

U.S. PATENT DOCUMENTS 4,664,869 A 5/1987 Mirzadeh et al. ..... 376/195
5,425,063 A 6/1995 Ferrieri et al. ..... 376/195

(Continued)

FOREIGN PATENT DOCUMENTS

CN 1166228 C 11/1997 ..... G21G 1/10
CN 101582299 A 11/2009 ..... G21C 3/04

(Continued)

OTHER PUBLICATIONS

Uddin et al. "Experimental studies on the proton-induced activation reactions of molybdenum in the energy range 22-67 MeV" Applied Radiation and Isotopes, 60 (2004), pp. 911-920.*

(Continued)

*Primary Examiner* — Jack W Keith
*Assistant Examiner* — Sharon M Davis
(74) *Attorney, Agent, or Firm* — Slayden Grubert Beard PLLC

(57) ABSTRACT

A method is provided for producing first and second radioactive isotopes using an accelerated particle beam that is directed to a first material and the first radioactive isotope is produced by a first nuclear reaction based on the interaction of the particle beam with the first material, said particle beam is also slowed down and subsequently directed to a second material, and the second radioactive isotope is produced by a second nuclear reaction based on the interaction of the particle beam with the second material. The effective cross-section for the induction of the first nuclear reaction at a first peak for a first particle energy is higher than an effective cross-section for the induction of the second nuclear reaction at a second peak for a second particle energy. A corresponding device includes an acceleration unit, a first exposure target having the first material and a second exposure target having the second material.

15 Claims, 2 Drawing Sheets

(56) References Cited

U.S. PATENT DOCUMENTS

| | | | | |
|---|---|---|---|---|
| 5,949,836 | A * | 9/1999 | Lidsky et al. | 376/156 |
| 6,011,825 | A | 1/2000 | Welch et al. | 376/195 |
| 6,130,926 | A | 10/2000 | Amini | 376/194 |
| 6,433,495 | B1 | 8/2002 | Wiberg | 315/502 |
| 6,444,990 | B1 | 9/2002 | Morgan et al. | 250/398 |
| 6,586,747 | B1 * | 7/2003 | Erdman | 250/432 R |
| 8,050,377 | B2 | 11/2011 | Russell, II et al. | 376/202 |
| 2005/0201505 | A1 | 9/2005 | Welch et al. | 376/168 |
| 2007/0040115 | A1 * | 2/2007 | Publicover et al. | 250/305 |
| 2007/0108922 | A1 * | 5/2007 | Amaldi | 315/502 |
| 2007/0273308 | A1 | 11/2007 | Fritzler et al. | 315/505 |
| 2011/0105821 | A1 | 5/2011 | Dieter et al. | 600/1 |
| 2011/0317795 | A1 | 12/2011 | Zhuikov et al. | 376/195 |
| 2012/0321027 | A1 | 12/2012 | Baurichter et al. | 376/194 |

FOREIGN PATENT DOCUMENTS

| | | | | |
|---|---|---|---|---|
| EP | 2104113 | A1 | 9/2009 | G21G 1/02 |
| JP | 5054796 | A | 5/1975 | A61K 51/00 |
| JP | 1254900 | A | 10/1989 | G21G 1/10 |
| JP | 2002214395 | A | 7/2002 | G21G 1/06 |
| RU | 2199165 | C1 | 2/2003 | G21G 1/10 |
| RU | 2373589 | C1 | 11/2009 | G21G 1/00 |
| WO | 00/19787 | A1 | 4/2000 | G21G 1/10 |
| WO | 02/31836 | A1 | 4/2002 | H05H 13/00 |
| WO | 2006/074960 | A1 | 7/2006 | C01G 99/00 |
| WO | 2008/047946 | A1 | 4/2008 | G21G 1/02 |
| WO | 2008/073468 | A1 | 6/2008 | G21G 1/04 |
| WO | 2009/026997 | A1 | 3/2009 | A61N 5/10 |
| WO | 2011/092175 | A1 | 8/2011 | G21G 1/10 |

OTHER PUBLICATIONS

International Search Report and Written Opinion, Application No. PCT/EP2011/051019, 14 pages, Jul. 13, 2011.

Chinese Office Action, Application No. 2011800079696, 12 pages, May 20, 2014.

* cited by examiner

METHOD AND DEVICE FOR PRODUCING TWO DIFFERENT RADIOACTIVE ISOTOPES

CROSS-REFERENCE TO RELATED APPLICATIONS

This application is a U.S. National Stage Application of International Application No. PCT/EP2011/051019 filed Jan. 26, 2011, which designates the United States of America, and claims priority to DE Patent Application No. 10 2010 006 433.5 filed Feb. 1, 2010. The contents of which are hereby incorporated by reference in their entirety.

TECHNICAL FIELD

This disclosure relates to a method and a device for making two different radioactive isotopes. Such radioactive isotopes are often used in the field of medical imaging, e.g. in PET imaging and SPECT imaging.

BACKGROUND

Radionuclides for PET imaging are often produced in the vicinity of the hospitals, for example with the aid of cyclotron production devices.

U.S. Pat. No. 6,433,495 describes the design of a target to be irradiated, which is used in a cyclotron for producing radionuclides for PET imaging.

WO 2006/074960 describes a method for producing radioactive isotopes which are made by irradiation by a particle beam.

U.S. Pat. No. 6,130,926 discloses a method for producing radionuclides with the aid of a cyclotron and a target design with rotating films.

JP 1254900 (A) describes a method in which a charged particle beam irradiates a target chamber with a gas contained therein in order to produce radioactive isotopes.

The radionuclides to be used for SPECT imaging are usually recovered from nuclear reactors, with highly enriched uranium often being used herein in order to obtain e.g. $^{99}$Mo/$^{99m}$Tc. However, as a result of international treaties, it will become ever more difficult in future to operate reactors with highly enriched uranium, which could lead to a bottleneck in the supply of radionuclides for SPECT imaging.

SUMMARY

In one embodiment, a method is provided for making a first radioactive isotope and a second radioactive isotope with the aid of an accelerated particle beam, comprising: directing the accelerated particle beam onto a first parent material and making the first radioactive isotope from the first parent material by a first nuclear reaction, which is induced by an interaction between the accelerated particle beam and the first parent material, directing the accelerated particle beam onto a second parent material and making the second radioactive isotope from the second parent material by a second nuclear reaction, which is induced by an interaction between the accelerated particle beam and the second parent material, wherein the effective cross section for inducing the first nuclear reaction by the interaction between the particle beam and the first parent material has a first peak at a first particle energy, and wherein the effective cross section for inducing the second nuclear reaction by the interaction between the particle beam and the second parent material has a second peak at a second particle energy, which is lower than the first particle energy, and wherein the first parent material and the second parent material are arranged one behind the other in the beam path of the particle beam in such a way that the accelerated particle beam first passes through the first parent material, as a result of which the first nuclear reaction is induced, the particle beam loses energy as a result thereof and subsequently irradiates the second parent material, as a result of which the second nuclear reaction is induced.

In a further embodiment, the thickness of the first parent material is provided such that when the particle beam penetrates said first parent material said particle beam is decelerated to a particle energy which lies in a region in which a nuclear reaction suitable for making and obtaining the second radioactive isotope is induced by the interaction between the decelerated particle beam and the second parent material. In a further embodiment, the particle beam, more particularly a proton beam, is accelerated to an energy of at least 15 MeV, more particularly at least 25 MeV, prior to passing through the first parent material. In a further embodiment, the particle beam, more particularly a proton beam, has an energy of less than 15 MeV prior to irradiating the second parent material. In a further embodiment, the first radioactive isotope is a radionuclide suitable for SPECT imaging, more particularly $^{99m}$Tc. In a further embodiment, the second radioactive isotope is a radionuclide suitable for PET imaging, more particularly $^{11}$C, $^{13}$N, $^{18}$F or $^{15}$O. In a further embodiment, the first parent material or the second parent material is a metal or a chemical compound, and is more particularly kept in a liquid solution or in a gaseous state.

In another embodiment, a device for making a first radioactive isotope and a second radioactive isotope with the aid of an accelerated particle beam may include: an accelerator unit for providing a particle beam, more particularly a proton beam, a first irradiation target, which comprises a first parent material and onto which the accelerated particle beam can be directed, wherein the first radioactive isotope can be made from the first parent material by a first nuclear reaction, which can be induced by an interaction between the accelerated particle beam and the first parent material, and wherein the particle beam is decelerated when passing through the first parent material, and a second irradiation target arranged behind the first irradiation target in the beam propagation direction, which second irradiation target comprises a second parent material, wherein the second radioactive isotope can be made from the second parent material by a second nuclear reaction, which can be induced by an interaction between the decelerated accelerated particle beam and the second parent material, wherein the effective cross section for the first nuclear reaction lies at a higher particle energy than the effective cross section for the second nuclear reaction.

In a further embodiment, the first radioactive isotope is a radionuclide suitable for SPECT imaging, more particularly comprises $^{99m}$Tc, and/or wherein the wherein the second radioactive isotope is a radionuclide suitable for PET imaging and more particularly comprises $^{11}$C, $^{13}$N, $^{18}$F or $^{15}$O. In a further embodiment, the accelerator unit is designed to accelerate the particle beam to an energy of at least 15 MeV, more particularly at least 25 MeV, prior to passing through the first parent material.

BRIEF DESCRIPTION OF THE DRAWINGS

Example embodiments will be explained in more detail below with reference to figures, in which.

DETAILED DESCRIPTION

Figure 1:
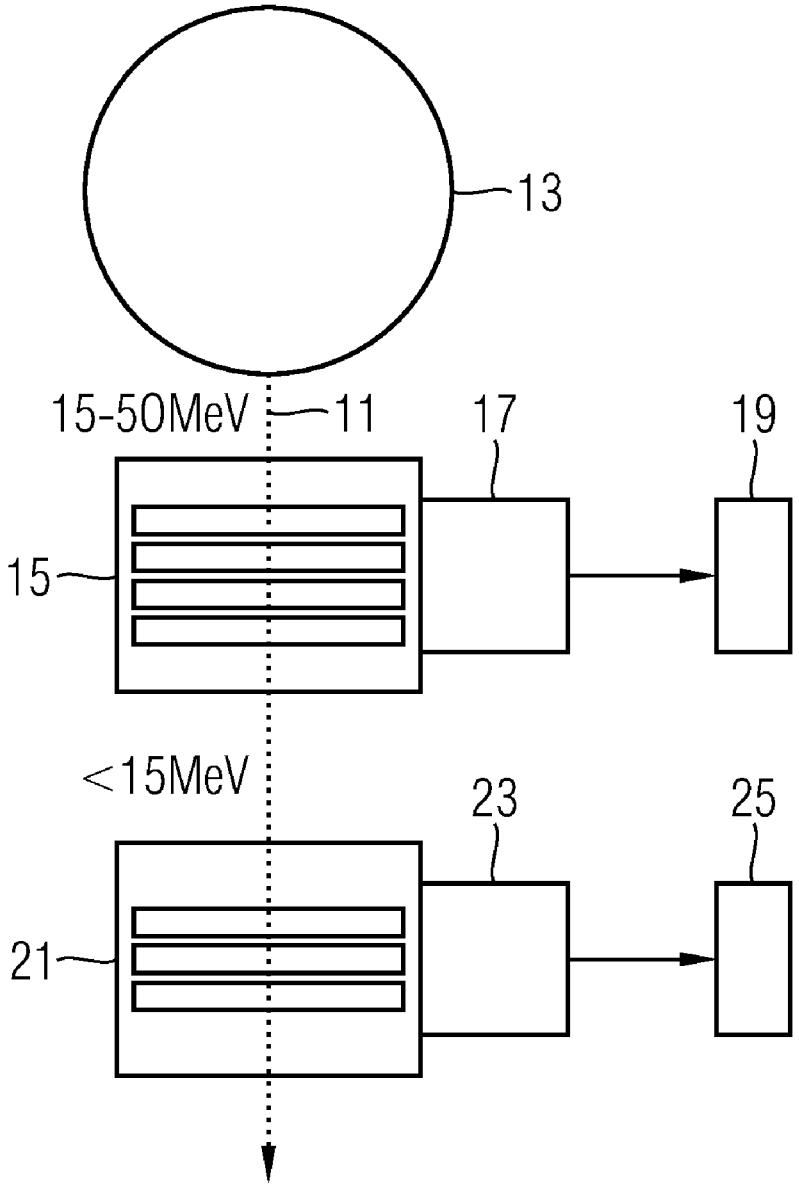
FIG. 1 shows a schematic overview of the design of the device for making two different radioactive isotopes, according to one embodiment.

Some embodiments provide a method and a device for making at least two different radioactive isotopes, which make it possible to produce radioactive isotopes—particularly for medical imaging—in a cost-effective fashion and enable a local, decentralized production.

In one embodiment, a method according for making a first radioactive isotope and a second radioactive isotope with the aid of an accelerated particle beam may include:

- directing the accelerated particle beam onto a first parent material and making the first radioactive isotope from the first parent material by a first nuclear reaction, which is induced by an interaction between the accelerated particle beam and the first parent material,
- directing the accelerated particle beam onto a second parent material and making the second radioactive isotope from the second parent material by a second nuclear reaction, which is induced by an interaction between the accelerated particle beam and the second parent material,
- wherein the effective cross section for inducing the first nuclear reaction by the interaction between the particle beam and the first parent material has a first peak at a first particle energy, and wherein the effective cross section for inducing the second nuclear reaction by the interaction between the particle beam and the second parent material has a second peak at a second particle energy, which is lower than the first particle energy, and wherein the first parent material and the second parent material are arranged one behind the other in the beam path of the particle beam in such a way that the accelerated particle beam first passes through the first parent material, as a result of which the first nuclear reaction is induced, the particle beam loses energy as a result thereof and subsequently irradiates the second parent material, as a result of which the second nuclear reaction is induced.

The particles, for example protons, are accelerated with the aid of an accelerator unit and shaped into a beam.

The interaction between the accelerated particle beam and the first parent material makes the first radioactive isotope, which can be obtained from the first parent material using various known methods.

The decelerated particle beam, which interacts with the second parent material, makes the second radioactive isotope, which in turn can be obtained from the second parent material.

This is how one particle beam is used to make and obtain two different radioactive isotopes using a single acceleration of particles to form a particle beam, and so the production of two different radioactive isotopes can be achieved in a cost-effective manner. Accelerating particles usually requires only a single accelerator unit of average size, which can also be installed and used locally. Using the above-described method, the two radioactive isotopes can be made locally in the vicinity or in the surroundings of the desired location of use, for example in the surroundings of a hospital.

This may be advantageous in the production of radionuclides for SPECT imaging in particular, because now, in contrast to conventional, non-local production methods in large installations such as in nuclear reactors and the accompanying distribution problems connected therewith, a local production solves many problems. Nuclear medicine units can plan their workflows independently from one another and are not reliant on complex logistics and infrastructure.

The first parent material and the second parent material are arranged separate from and behind one another in the beam path. The particle beam with a defined first energy passes through the first parent material, with the first energy being higher than the second energy with which the particle beam subsequently irradiates the second parent material. In particular, as a result of this it is only necessary to accelerate the particle beam to a first energy. The energy required for irradiating the second parent material is, at least in part, achieved by decelerating the particle beam as it passes through the first material.

In particular, the thickness of the first parent material can be provided and matched to the subsequent nuclear reaction of the particle beam with the second parent material such that when the particle beam penetrates said first parent material said particle beam is decelerated to a particle energy which lies in a region in which a nuclear reaction suitable for making and obtaining the second radioactive isotope is induced by the interaction between the decelerated particle beam and the second parent material.

This embodiment may ensure that the thickness of the first parent material is thin enough such that the emerging particle beam, after emerging from the first parent material, has a high enough energy in order to cause the desired interaction in the second parent material. Second, the thickness can be thick enough to decelerate the particle beam into the required interaction range such that additional energy modulators are no longer required in front of the second parent material.

In particular, the particle beam can be accelerated to an energy of at least 15 MeV, more particularly at least 25 MeV and up to an energy of over 50 MeV prior to passing through the first parent material. This may ensure that the first nuclear reaction takes place in an energy range which lies for making an isotope that can be used for SPECT imaging, for example for making $^{99m}$Tc from a suitable parent material.

After passing through the first parent material and prior to irradiating the second parent material, the particle beam can have an energy of less than 15 MeV. This may ensure that the energy of the particle beam comes to lie in a region in which the interaction cross section is situated for inducing a nuclear reaction for producing a radionuclide for PET imaging, more particularly for producing $^{11}$C, $^{13}$N, $^{18}$F or $^{15}$O from a suitable known parent material.

Depending on the desired radioactive isotope to be made, the first parent material and/or the second parent material can be present as a metal, be a chemical compound, be present in solid form or be present in liquid form. By way of example, use can be made of a liquid solution in which naturally occurring or enriched isotopes are situated, which then make the desired radioactive isotope as a result of irradiation.

In one embodiment, a device according for making a first radioactive isotope and a second radioactive isotope with the aid of an accelerated particle beam may include:

- an accelerator unit for providing a particle beam, more particularly a proton beam,
- a first irradiation target, which comprises a first parent material and onto which the accelerated particle beam can be directed, wherein the first radioactive isotope can be made from the first parent material by a first nuclear reaction, which can be induced by an interaction between the accelerated particle beam and the first parent material, and wherein the particle beam is decelerated when passing through the first parent material, a second irradiation target arranged behind the first irradiation target in the beam propagation direction, which second irradiation target comprises a second parent material, wherein the second radioactive isotope can be made from the second parent material by a second nuclear reaction, which can be induced by an interaction between the decelerated accelerated particle beam and the second parent material, wherein the effective cross section for the first nuclear reaction lies at a higher particle energy than the effective cross section for the second nuclear reaction.

The first radioactive isotope can be a radionuclide suitable for SPECT imaging, more particularly $^{99m}$Tc. The second radioactive isotope can be a radionuclide suitable for PET imaging, more particularly $^{11}$C, $^{13}$N, $^{18}$F or $^{15}$O.

The accelerator unit can be designed to accelerate the particle beam to an energy of at least 15 MeV, more particularly at least 25 MeV, prior to passing through the first parent material.

FIG. 1 shows an overview of the device for making two different radionuclides, one for SPECT imaging and the other for PET imaging.

The proton beam 11 is provided by an accelerator unit 13 such as e.g. a cyclotron and initially has a first energy of between 15 MeV and 50 MeV.

Subsequently, the proton beam is directed onto a first target unit 15, which comprises a stack of the parent material that makes the $^{99}$Mo/$^{99m}$Tc, to be used for SPECT imaging, in a nuclear reaction as a result of the interaction with the particle beam. The first radioactive isotope 19 made in the stack is extracted with the aid of a decoupling device 17 and collected such that it is available for further use.

Here, $^{100}$Mo can be the target material for making $^{99m}$Tc such that $^{99m}$Tc emerges from the following nuclear reaction $^{100}$Mo (p,n) $^{99}$Tc. As a result of passing through the first target unit 15, the proton beam 11 is decelerated to an energy which is below 15 MeV.

The proton beam 11 is subsequently directed onto a second target unit 21, in which a stack of the second parent material is situated and the latter makes the radionuclide for PET imaging in a further nuclear reaction as a result of the interaction with the proton beam 11.

By way of example, the second radioactive isotope can be $^{11}$C, $^{13}$N, $^{18}$F or $^{15}$O. The second radioactive isotope 25 is likewise extracted from the second target unit 21 with the aid of a further decoupling device 23 and collected such that it is available for further use.

The following table provides an overview of target materials and nuclear reactions by means of which PET radionuclides can be made.

| Radio-nuclide | Nuclear reaction | Energy range MeV | Calculated yield MBq/μA · h | Target | Product made in target |
|---|---|---|---|---|---|
| $^{11}$C | $^{14}$N (p, α) | 13→3 | 3820 | $N_2$ ($O_2$) | $^{11}$CO, $^{11}CO_2$ |
| $^{13}$N | $^{16}$O (p, α) | 16→7 | 1665 | $H_2{}^{16}O$ | $^{13}NO_2^-$, $^{13}NO_3^-$ |
| $^{15}$O | $^{14}$N (d, n) | 8→0 | 2368 | $N_2$ ($O_2$) | $^{15}$OO |
| | $^{15}$N (p, n) | 10→0 | 2220 | $^{15}N_2$ ($O_2$) | $^{15}$OO |
| $^{18}$F | $^{18}$O (p, n) | 16→3 | 2960 | $H_2{}^{18}O$ $^{18}O_2$/($F_2$) | $^{18}F_{aq}^-$ [$^{18}$F] $F_2$ |
| | $^{14}$Ne (d, α) | 14→0 | 1110 | Ne ($F_2$) | [$^{18}$F] $F_2$ |

Figure 2:
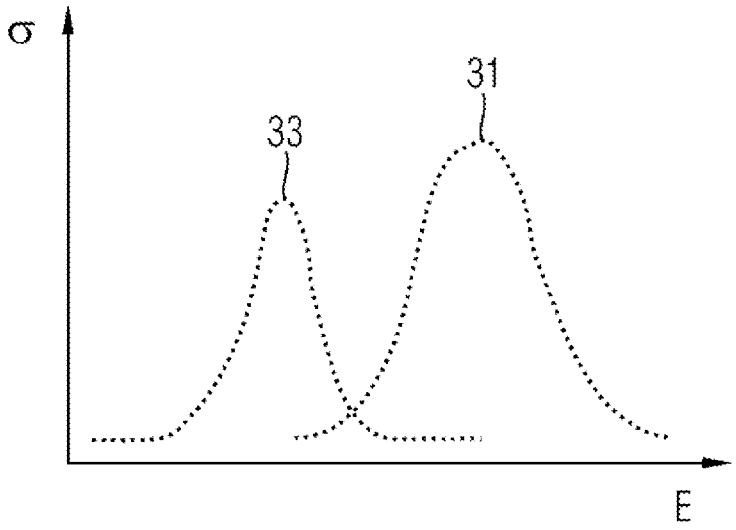
FIG. 2 shows a diagram for illustrating different effective cross sections for different nuclear reactions with different parent materials, according to one embodiment.

FIG. 2 shows, in a very schematic diagram, in which the effective cross section σ, dependent on the particle energy E of the particle beam, is plotted for various nuclear reactions. A first effective cross section curve 31 denotes the first nuclear reaction, which is induced by the particle beam in the first parent material. A second effective cross section curve 33 denotes the second nuclear reaction, which is induced by the particle beam in the second parent material.

It can be seen that the peak for the first effective cross section lies at significantly higher energies than the peak for the effective cross section at lower energies. These circumstances are used in the device or in the method because one and the same particle beam can now be used to trigger the desired nuclear reactions in succession. The deceleration of the particle beam occurring during the first nuclear reaction is desired in this case because said particle beam thus reaches the energy range expedient for the second nuclear reaction.

Figure 3:
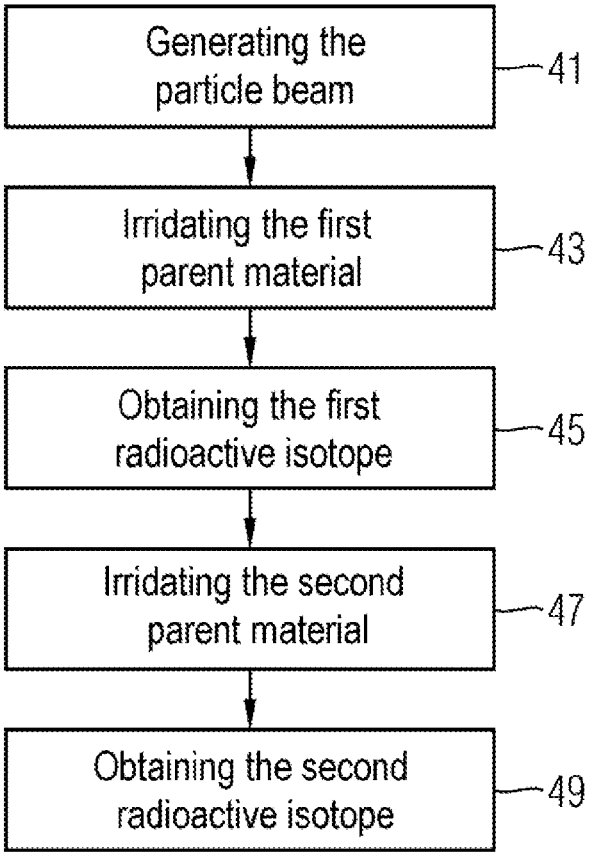
FIG. 3 shows a diagram for illustrating the method steps that can be carried out when carrying out the method, according to one embodiment.

FIG. 3 shows a schematic illustration of the method steps in one embodiment of the method.

The particle beam is initially generated. This can be brought about with the aid of a cyclotron which generates a particle beam that always has the same final energy (step 41).

The particle beam is subsequently directed onto a target which comprises the first parent material (step 43). As a result of the interaction of the particle beam with the first parent material, a first nuclear reaction, in which the first radioactive isotope is made, is induced. The made radioactive isotope is obtained by known extension methods (step 45).

Subsequently the decelerated particle beam is directed onto a second target, which comprises a second parent material (step 47). The second radioactive isotope is created in a second nuclear reaction, which second radioactive isotope is subsequently obtained by known extraction methods (step 49).

LIST OF REFERENCE SIGNS

11 Proton beam
13 Accelerator unit
15 First target unit
17 First decoupling device
19 First radioactive isotope
21 Second target unit
23 Further decoupling device
25 Second radioactive isotope
31 First effective cross section curve
33 Second effective cross section curve
41 Step 41
43 Step 43
45 Step 45
47 Step 47
49 Step 49

What is claimed is:

1. A method for making a first radioactive isotope and a second radioactive isotope with the aid of an accelerated particle beam, comprising:

directing the accelerated particle beam onto a first multi-layer stack of a first parent material and making the first radioactive isotope from the first stack of the first parent material by a first nuclear reaction, which is induced by an interaction between the accelerated particle beam and the first stack of the first parent material, directing the accelerated particle beam onto a second multi-layer stack of a second parent material and making the second radioactive isotope from the second stack of the second parent material by a second nuclear reaction, which is induced by an interaction between the accelerated particle beam and the second stack of the second parent material, wherein an effective cross section for inducing the first nuclear reaction by the interaction between the particle beam and the first stack of the first parent material has a first peak at a first particle energy, and wherein an effective cross section for inducing the second nuclear reaction by the interaction between the particle beam and the second stack of the second parent material has a second peak at a second particle energy, which is lower than the first particle energy, and wherein the first stack of the first parent material and the second stack of the second parent material are arranged in series and physically spaced apart from each other along a beam path of the particle beam in such a way that the accelerated particle beam first passes through the first stack of the first parent material, as a result of which the first nuclear reaction is induced, the particle beam loses energy as a result thereof and subsequently irradiates the second stack of the second parent material, as a result of which the second nuclear reaction is induced, and wherein a thickness of the first stack of the first parent material is selected such that when the particle beam penetrates the first stack of the first parent material the particle beam is decelerated to a particle energy that lies in a predefined region for inducing a nuclear reaction, which makes the second radioactive isotope, upon the interaction between the decelerated particle beam and the second stack of the second parent material.

2. The method of claim 1, wherein the particle beam is accelerated to an energy of at least 15 MeV prior to passing through the first stack of the first parent material.

3. The method of claim 1, wherein the particle beam, has an energy of less than 15 MeV prior to irradiating the second stack of the second parent material.

4. The method of claim 1, wherein the first radioactive isotope is a radionuclide suitable for SPECT imaging.

5. The method of claim 1, wherein the second radioactive isotope is a radionuclide suitable for PET imaging.

6. The method of claim 1, wherein the first parent material or the second parent material is a metal or a chemical compound kept in a liquid solution or in a gaseous state.

7. The method of claim 1, wherein the particle beam is a proton beam that is accelerated to an energy of at least 25 MeV prior to passing through the first stack of first parent material.

8. The method of claim 1, wherein the first radioactive isotope comprises $^{99m}$Tc.

9. The method of claim 1, wherein the second radioactive isotope comprises $^{11}$C, $^{13}$N, $^{18}$F, or $^{15}$O.

10. A device for making a first radioactive isotope and a second radioactive isotope with the aid of an accelerated particle beam, comprising:

an accelerator unit configured to provide a particle beam, a first irradiation target comprising a first multi-layer stack of a first parent material and onto which the accelerated particle beam is directed, wherein the first radioactive isotope is made from the first stack of the first parent material by a first nuclear reaction, which is induced by an interaction between the accelerated particle beam and the first stack of the first parent material, and wherein the particle beam is decelerated when passing through the first stack of the first parent material, a second irradiation target arranged downstream of the first irradiation target in the beam propagation direction, which second irradiation target comprises a second multi-layer stack of a second parent material, wherein the second radioactive isotope is made from the second stack of the second parent material by a second nuclear reaction, which is induced by an interaction between the decelerated accelerated particle beam and the second stack of the second parent material, and wherein an effective cross section for the first nuclear reaction lies at a higher particle energy than an effective cross section for the second nuclear reaction, and wherein a thickness of the first stack of the first parent material is selected such that when the particle beam penetrates the first stack of the first parent material the particle beam is decelerated to a particle energy that lies in a predefined region for inducing a nuclear reaction, which makes the second radioactive isotope, upon the interaction between the decelerated particle beam and the second stack of the second parent material.

11. The device as claimed in claim 10, wherein at least one of the first and second radioactive isotopes is a radionuclide suitable for SPECT imaging.

12. The device of claim 10, wherein the accelerator unit is designed to accelerate the particle beam to an energy of at least 15 MeV prior to passing through the first stack of the first parent material.

13. The device of claim 10, wherein the particle beam is a proton beam that is accelerated to an energy of at least 25 MeV prior to passing through the first stack of the first parent material.

14. The device of claim 10, wherein the first radioactive isotope comprises $^{99m}$Tc.

15. The device of claim 10, wherein the second radioactive isotope comprises $^{11}$C, $^{13}$N, $^{18}$F, or $^{15}$.

* * * * *